United States Patent [19]

Delmore

[11] 4,088,293

[45] May 9, 1978

[54] LAY-IN LIGHT FIXTURE RETAINER CLIP

[75] Inventor: Martin F. Delmore, Seven Hills, Ohio

[73] Assignee: Erico Products, Inc., Cleveland, Ohio

[21] Appl. No.: 693,694

[22] Filed: Jun. 7, 1976

[51] Int. Cl.[2] ..... B42F 13/00; F21V 21/08

[52] U.S. Cl. ..... 248/500; 248/343

[58] Field of Search ..... 248/500, 510, 342, 343, 248/344; 24/81 B, 81 CC, 81 FT; 240/52.1, 78 H, 78 HH

[56] References Cited

U.S. PATENT DOCUMENTS

| | | | |
|---|---|---|---|
| 1,940,505 | 12/1933 | Pavlick | 24/81 B |
| 2,345,004 | 3/1944 | Place | 24/81 B |
| 3,279,729 | 10/1966 | Buttriss | 24/73 B |
| 3,371,900 | 3/1968 | Jacobs | 248/343 |

FOREIGN PATENT DOCUMENTS

| | | | |
|---|---|---|---|
| 1,199,832 | 12/1959 | France | 24/81 B |

*Primary Examiner*—Robert A. Hafer
*Attorney, Agent, or Firm*—Maky, Renner, Otto & Boisselle

[57] ABSTRACT

A hold-down and retaining clip for a lay-in light fixture secures the fixture to the T-bar frame of the suspended ceiling against both vertical and lateral movement. The main body portion of the clip has an L-shape configuration adapted to lie substantially adjacent the stem in one bottom flange of the T-bar. The upper vertical leg of the clip includes an extended center portion which is formed in an enlarged bend extending over the top of the stem with substantial clearance and terminates in an upwardly rebent edge adapted to engage the far side of the stem. The shorter lateral portions of the vertical leg have their upper edges bent toward the stem and are adapted to engage the near side of the stem at a slightly higher elevation than the terminal edge on the far side of the stem. The lower horizontal leg of the clip includes a heel adapted to bear against the stem adjacent the bottom flange and also includes a center portion at a slightly higher elevation than the foot of the lateral portions which form the heel. The center portion is provided with barbs directed toward the stem which are adapted to engage and bite into a horizontal peripheral flange of the light fixture when the same is inserted between the center elevated portion and the lower lateral portions of the bottom leg of the clip. The clip is adapted to accommodate either round or rectangular head T-bar or lighting fixtures which have upturned peripheral flanges of varying degree or no upturned flanges at all.

12 Claims, 6 Drawing Figures

LAY-IN LIGHT FIXTURE RETAINER CLIP

This invention relates generally as indicated to a lay-in light fixture retainer clip and more particularly to a clip for such light fixtures which will securely fasten lighting fixtures to the framing members of suspended ceilings.

Ceiling light fixtures which are supported by the framing members of a suspended ceiling are now required by the National Electrical Code to be securely fastened to the ceiling framing member.

When lightbulbs are replaced in suspended ceiling light fixtures or when diffuser pans or grids are removed for cleaning purposes, the lighting fixture may move slightly with respect to the framing members and if not properly replaced, the fixture may fall. Moreover, it may be difficult to replace bulbs or other components if the fixture can move vertically. Prior art hold-down clips for light fixtures in suspended ceilings have been provided, but these usually require a screw-type fastener securing the clip to the stem of the T-bar which is normally used in the framing systems of suspended ceilings. The screw is normally on the side of the stem opposite the lighting fixture and to secure the clip in place, oftentimes requires that the acoustical panel adjacent the fixture on the other side of the framing member must be removed. Such clips also, of course, require the use of a tool such as a screwdriver or nut driver. When suspended ceiling acoustical panels are removed, they are often difficult to replace and even more difficult to keep clean when handling.

Accordingly, a retaining clip which can be simply snapped in place and which does not require the tightening of fasteners or the removal of adjacent acoustical panels makes the job of securing lighting fixtures to suspended ceiling framing systems much easier. Moreover, it is important that the clip, when secured, hold the lighting fixture with respect to the framing system against both vertical and horizontal movement. Finally, since the construction of the framing system as well as the peripheral edges of the pan of the lighting fixture may vary from manufacturer to manufacturer, it is important to provide a single clip which will accommodate a variety of framing systems and lighting fixtures.

It is accordingly a principal object of the present invention to provide a retaining clip for a lay-in lighting fixture which can be easily installed.

It is another principal object to provide a clip of the type noted which will accommodate a variety of framing systems for suspended ceilings as well as a variety of lighting fixture constructions.

Still another object is to provide a clip of the type noted which does not require the use of screws or other type fasteners which in turn require the use of screwdrivers or nut drivers, for example.

A further object is the provision of such clip which can be easily manufactured in large quantities at low cost.

Other objects and advantages of the present invention will become apparent as the following description proceeds.

To the accomplishment of the foregoing and related ends, the invention then comprises the features hereinafter fully described and particularly pointed out in the claims, the following description and the annexed drawing setting forth in detail a certain illustrative embodiment of the invention, this being indicative, however, of but one of the various ways in which the principles of the invention may be employed.

Figure 1:
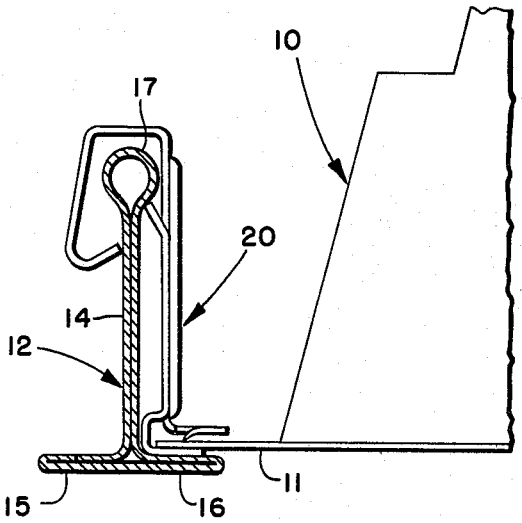
FIG. 1 is a vertical section through a suspended ceiling frame member illustrating the clip of the present invention in edge elevation securing the lighting fixture, illustrated as partially broken away and in section, to the frame member.
Figure 2:
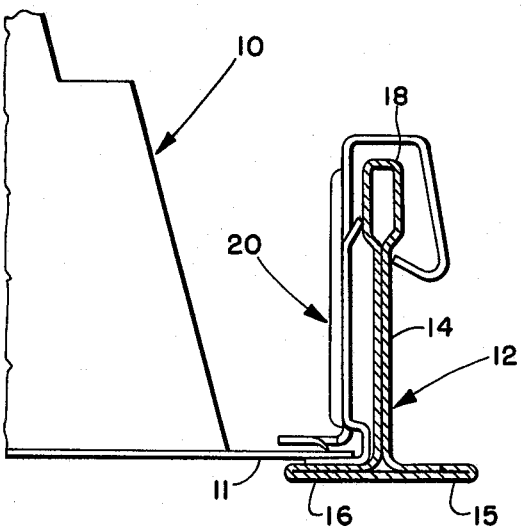
FIG. 2 is a view similar to FIG. 1 illustrating the application of the clip to a frame member having a rectangular, rather than round, head on the stem of the T-bar.

Referring first to FIGS. 1 and 2, it will be seen that the lighting fixture 10 includes a bottom plate or flange 11 projecting horizontally. Such fixture is normally supported in suspended ceilings by a system of suspended framing members 12. Such framing members are usually in the form of inverted Tees which include a stem 14 and laterally projecting bottom flanges 15 and 16. As seen in comparing FIGS. 1 and 2, the stem of the frame may either have a round head indicated at 17 in FIG. 1 or a rectangular head as indicated at 18 in FIG. 2. Such framing members may be of other configurations, but they are most commonly of the rolled configurations shown.

Prior to the afore-noted code requirements, it was not an uncommon practice simply to support the lighting fixture 10 by means of its bottom flange 11 on the flange 16 of the supporting frame member without any fastening connection between the bottom flange of the fixture and the bottom flange of the frame member.

With the clip of the present invention seen at 20 in FIGS. 1 and 2, the frame member is securely fastened to the lighting fixture and vice versa, retaining the lighting fixture with respect to the framing system against both horizontal and vertical movement.

Figure 3:
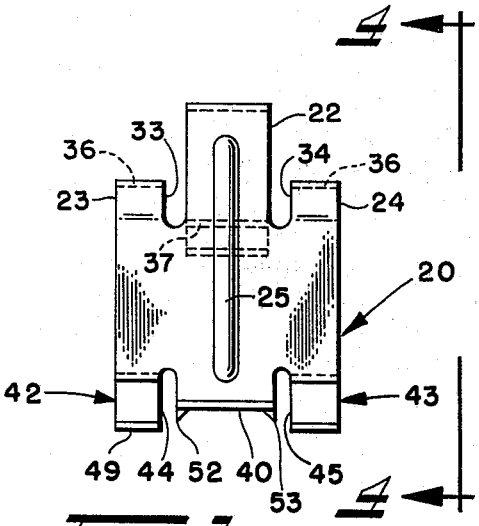
FIG. 3 is a plan view of the clip of the present invention.
Figure 4:
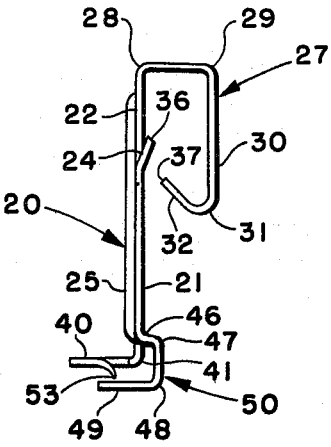
FIG. 4 is an edge elevation of the clip as seen from the line 4—4 of FIG. 3.

Referring now additionally to FIGS. 3 and 4, it will be seen that the clip includes a main body portion having a generally L-shape configuration with the upper leg 21 of such L including a center elongated portion 22 and two lateral portions 23 and 24. The center portion includes a vertical stiffening rib 25 which extends substantially the entire vertical height of the vertical leg of the L.

The center portion of the upper vertical leg is formed in an enlarged bend indicated generally at 27 by first being bent horizontally as indicated at 28 and then vertically downwardly as indicated at 29. The center portion then extends downwardly a substantial distance as indicated at 30 with the terminal end thereof being then bent upwardly at approximately a 45° angle as indicated at 31 to form the upwardly inclined terminal edge portion 32.

The upper ends of the lateral portions 23 and 24 which are separated from the center portions by the slots 33 and 34, respectively, are bent slightly toward the terminal edge of the center portion. Thus the upper leg of the clip includes two substantially laterally spaced biting edges indicated at 36 on the end of each of the bent lateral portions and a center biting edge 37 on the terminal end 32 of the center portion. Such biting edges restrict the passageway into the enlarged bend 27 and are adapted to engage the opposite sides of the stem 14 of the Tees 12 when the clip is in position, with at least one of such biting edges being beneath the enlarged bulb or rectangular upper end of the Tee.

The lower horizontal leg of the clip again comprises a center portion indicated at 40 which is bent horizontally at 41. The lateral portions 42 and 43 which are separated from the center portion by the slots 44 and 45, respectively, are first bent rearwardly as indicated at 46 and then vertically downwardly as indicated at 47 and then horizontally as indicated at 48 to form a horizontal foot 49 parallel to but lower than the horizontal portion 40 of the center portion. In this manner, the two lateral portions form a heel 50 of the foot, such heel being adapted to bear against and nest within the corner of the Tee between the bottom flange and the stem.

The horizontal center portion 40 is provided along each lateral edge with downwardly and rearwardly struck barbs seen at 52 and 53. The biting tips extend substantially to the horizontal plane of the upper surface of the foot portion 49 of each of the lateral portions and are adapted to bite into the horizontal peripheral flange 11 of the lighting fixture 10 when such flange is inserted between the portions 49 of the bottom and the portion 40 on top. The biting engagement of such barbs with the flange is seen in FIGS. 1 and 2.

Figure 5:
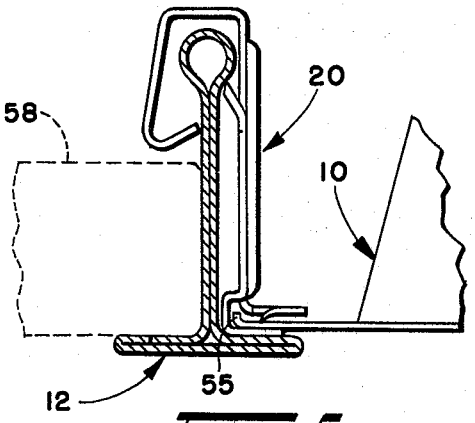
FIG. 5 is an illustration of the clip similar to that of FIG. 1 illustrating the clip holding in place a lighting fixture having one form of edge flange configuration which is different from that of FIGS. 1 and 2.
Figure 6:
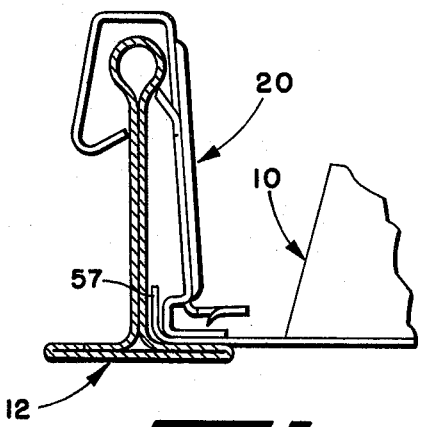
FIG. 6 is a view similar to FIG. 5 illustrating the clip holding in place a lighting fixture having a somewhat larger upturned peripheral flange.

The barbs may also permit the entry of a light fixture flange if the flange is provided with a slight upturned edge or bead as indicated at 55 in FIG. 5. The barbs simply cam over the bead or slight flange indicated in FIG. 5. However, if the upturned flange of the light fixture is significant as indicated in FIG. 6 at 57, then such flange will fit behind the heel 50 of the clip, with the clip, when secured to the frame holding the light fixture, in any case, against both vertical and lateral movement.

As seen in FIG. 5, the clip 20 clears the acoustical tile 58 on the opposite side of the lighting fixture and such acoustical tile or panel normally need not be removed for installation of the clip.

The clip is manufactured by a die stamping operation from spring steel and is annealed in the usual manner. Accordingly, the clip is hard and yet still has some degree of resilience.

The clip may be installed in a number of ways. In FIG. 1 or FIG. 2, the clip may be first secured to the lighting fixture by inserting the flange 11 into the slot between the horizontal portions 40 and 49 with the barbs biting into the flange and securing the same in place. The entire fixture may then be lowered with the upper edge of the stem of the frame engaging and camming open the enlarged bend when the upper edge engages the inclined portion 32 at the terminal end of the center portion of the upper leg. Regardless of the type of frame, the clip will securely engage and bite into the stem of the frame on both sides thereof and such engagement resists rotation of the clip about the axis of the upper edge of the stem. The two lateral biting edges 36 resist rotation about a horizontal axis transversely through the stem.

The same manner of installation may be accomplished in the FIG. 5 embodiment with the slight flange or bead 55 simply camming passed the barbs 52 and 53. In the FIG. 6 embodiment, the clip may be inserted after the light fixture has been laid in place and when secured, as illustrated, the lighting fixture is held in place by the engagement of the heel 50 with the inside of the upturned flange 57 of the lighting fixture forcing the same against both the stem of the Tee and the adjacent bottom flange. The stiffening rib resists defection of the foot and heel of the clip away from the stem of the Tee.

In any event, with the clip of the present invention, the fixtures can readily be secured to the ceiling framing system against both vertical and horizontal movement.

I, therefore, particularly point out and distinctly claim as my invention:

1. A hold-down and retaining clip for a lay-in light fixture in a suspended ceiling supported on a grid of inverted T-bars, said clip comprising a main body portion of L-shape configuration having an upper vertical leg and a lower horizontal leg adapted to lay substantially adjacent the stem and one bottom flange of the T-bar, respectively, said upper vertical leg of the clip being formed at its top in an enlarged bend and adapted to extend over the top of such stem with substantial clearance and terminating in a rebent edge adapted to engage the far side of such stem, said lower horizontal leg of the clip engaging and retaining the peripheral edge of a lay-in light fixture, and said upper vertical leg including an upwardly inclined bent portion extending toward the near side of such stem.

2. A clip as set forth in claim 1 wherein said rebent edge is formed with a cam surface adapted to restrict the bottom opening of the bend whereby the clip may be snapped over the top of such stem.

3. A clip as set forth in claim 2 wherein said cam surface extends at an upwardly inclined angle and terminates in a biting edge.

4. A clip as set forth in claim 1 wherein said lower horizontal leg includes a heel portion extending from the vertical leg toward such stem adapted to bear against such stem.

5. A clip as set forth in claim 3 including a biting edge on said upwardly inclined bent portion adapted to engage the near side of such stem at a different elevation than the biting edge adapted to engage the far side of such stem.

6. A clip as set forth in claim 3 including two upwardly inclined bent portions at the same elevation on opposite sides of a center portion which is bent to form said enlarged bend extending over the top of such stem.

7. A clip as set forth in claim 6 including a stiffening rib extending vertically in the center portion of said clip to resist flexing of the upper vertical leg of the clip.

8. A clip as set forth in claim 1 wherein said lower horizontal leg is formed of two vertically separated portions forming a thin horizontal slot therebetween.

9. A clip as set forth in claim 8 wherein one of said two vertically separated portions is formed with a rearwardly directed struck barb adapted to bite into a light fixture flange and resist removal when such flange is inserted in such slot.

10. A clip as set forth in claim 9 wherein said barb is struck from the edge of the upper of said vertically separated portions.

11. A clip as set forth in claim 10 wherein the lower of said vertically separated portions comprises two laterally separated portions on each side of the upper of said vertically separated portions.

12. A hold-down and retaining clip for a lay-in light fixture in a suspended ceiling supported on a grid of inverted T-bars, said clip comprising a main body portion of L-shape configuration having an upper vertical leg and a lower horizontal leg adapted to lay substantially adjacent the stem and one bottom flange of the T-bar, respectively, said upper vertical leg of the clip being formed at its top in an enlarged bend and adapted to extend over the top of such stem with substantial clearance and terminating in a rebent edge adapted to engage the far side of such stem, said lower horizontal leg of the clip engaging and retaining the peripheral edge of a lay-in light fixture, said lower horizontal leg being formed in two vertically separated portions forming a thin horizontal slot therein, and the lower of said two vertically separated portions including a heel portion extending initially from the vertical leg toward such stem adapted to bear against such stem and one bottom flange of the T-bar whereby a light fixture with an upturned flange may be trapped between the clip heel and the T-bar.

* * * * *